United States Patent [19]

Whyte

[11] 4,279,282

[45] Jul. 21, 1981

[54] BARREL HOOP DRIVERS

[76] Inventor: Robert N. Whyte, 28 Rubislaw-Den South, Aberdeen, Scotland

[21] Appl. No.: 69,621

[22] Filed: Aug. 27, 1979

[51] Int. Cl.[3] ..... B27H 5/10

[52] U.S. Cl. ..... 147/9

[58] Field of Search ..... 100/247; 147/7, 9

[56] References Cited

U.S. PATENT DOCUMENTS

| | | | |
|---|---|---|---|
| 821,362 | 5/1906 | Holmes et al. | 147/7 |
| 1,009,563 | 11/1911 | Pettit | 147/7 |

FOREIGN PATENT DOCUMENTS

| | | | |
|---|---|---|---|
| 1344905 | 1/1974 | United Kingdom | 147/9 |

*Primary Examiner*—Howard N. Goldberg

*Attorney, Agent, or Firm*—Auslander, Thomas & Morrison

[57] ABSTRACT

A claw for use in a barrel hoop driver which allows the top hoop of a barrel to be driven beyond the barrel edge thereby allowing barrels for reuse to have their staves tightened without fitting new end hoops. The claw has spaced guide members controlling the effective depth of a blade for engagement with the hoops, the spaced arrangement of the guide members preventing accumulation of wood shavings on the blade.

5 Claims, 6 Drawing Figures

BARREL HOOP DRIVERS

This invention relates to a machine for use in forming, and for the maintenance of barrels or kegs of the type comprising a plurality of wooden slats held together by metal hoops. For convenience hereinafter and in the appended claims, the machine will be referred to as a "barrel hoop driver".

Our U.K. Patent No. 1,344,905 describes and claims a barrel hoop driver comprising a base, an upright frame mounted on said base, a press head slidably movable vertically towards and away from said base on guide rods carried by said frame, a plurality of push arms spaced around the circumference of a circle, and being pivotally mounted at one end on and movable with the press head, pivotally biased towards the centre of said circle, and adapted at their free ends drivingly to engage a hoop on a barrel when the latter is supported on said base, and a pair of hydraulic rams for effecting movement of said press head and having their cylinders mounted on said frame and their pistons connected to said press head.

While the arrangement shown in the drawings of the U.K. Patent affords a quick and effective means for forcing hoops into position on the barrels, it suffers from a disadvantage in that the design of the free ends of the push arm do not allow the barrel end hoops to be driven beyond the barrel ends. The free ends are formed as claws each having a steel blade extending beyond a solid skirt, the skirt edge being equispaced by about 1/16 inch from the blade edge along its length, and as a barrel hoop is about 1/16 inch thick the skirt provides a guide for the blade to engage the hoop to be driven onto the barrel.

However, if it was attempted to drive an end hoop past the barrel edge wood parings tended to become trapped on the claw and this prevented the claw from operating to its maximum effectiveness, as the working thickness of the blade was thus reduced below 1/16 inch and the claw tended to slip off the hoops. Increasing the working thickness did not solve this problem as the blade would then dig into the wood to an even greater extent.

An object of this invention is to provide means which will allow a barrel hoop driver to drive end hoops past the barrel edge. Barrels shrink in use and if they are to be reused it is therefore necessary to drive the hoops further along the barrel to retighten them, but if the end hoops cannot be driven past the barrel ends it is necessary to remove them and fit new, smaller-diameter end hoops. There would therefore be considerable saving in time and labour by making it possible to drive the end hoops further onto the barrel.

According to the present invention there is provided a claw for a barrel hoop driver, having a rigid driving member which presents a flanged face for engagement with a barrel hoop, guide members spaced inwardly from the edge of the flanged face by a distance about equal to the thickness of a barrel hoop, and means for pivotal connection of the driving member to a push arm of a barrel hoop driver, wherein the guide members are mutually spaced along the flanged face.

Preferably, the guide members are formed by plates extending towards and terminating short of the edge of the flanged face, and preferably the guide members are located one at each end portion of the flanged face. In this way end hoops can be driven onto the barrel and the spaced arrangement of the guide members prevents wood paring being trapped and reducing the claw's effectiveness.

An embodiment of the invention will now be described, by way of example, with reference to the accompanying drawings, in which.

Figure 1:
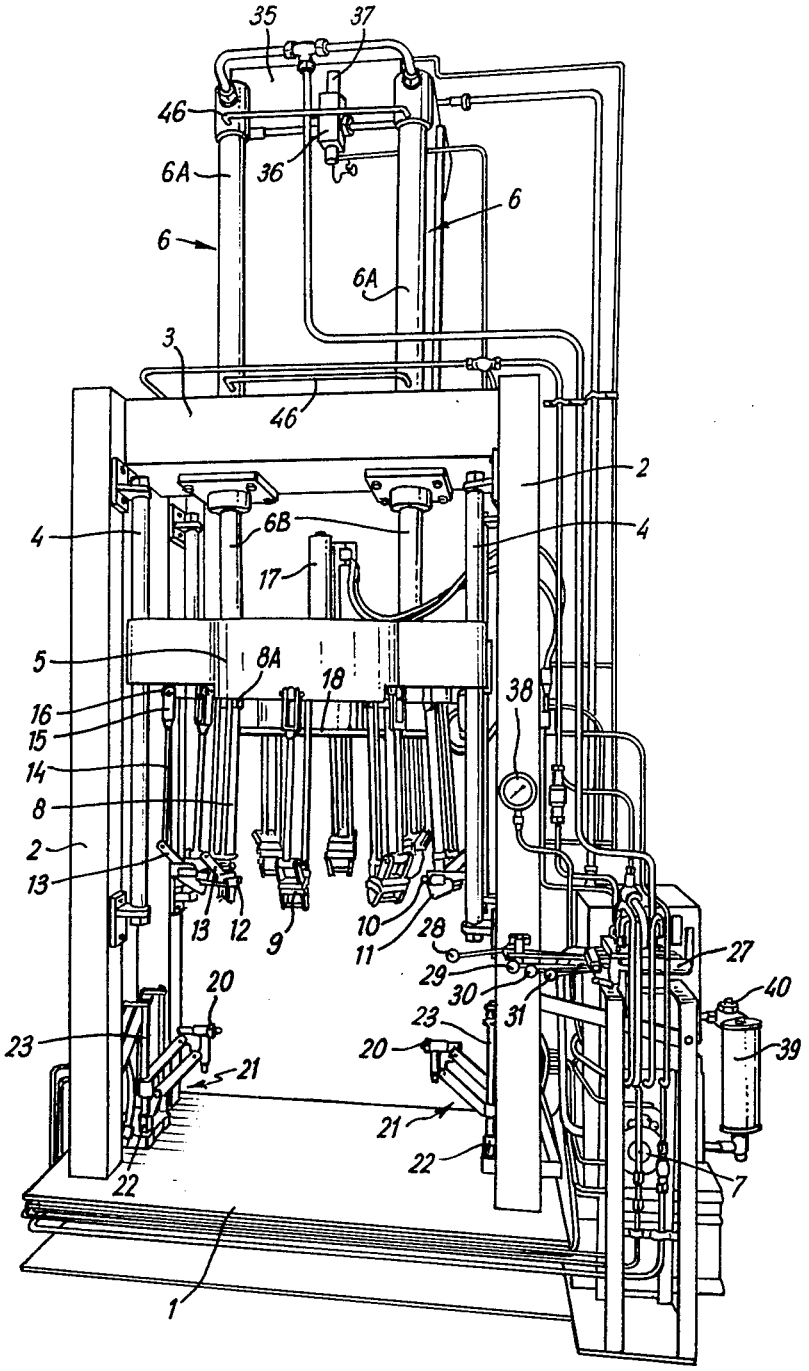
FIG. 1 is a front perspective view of a barrel hoop driver showing the press head raised and out-of-use.
Figure 2:
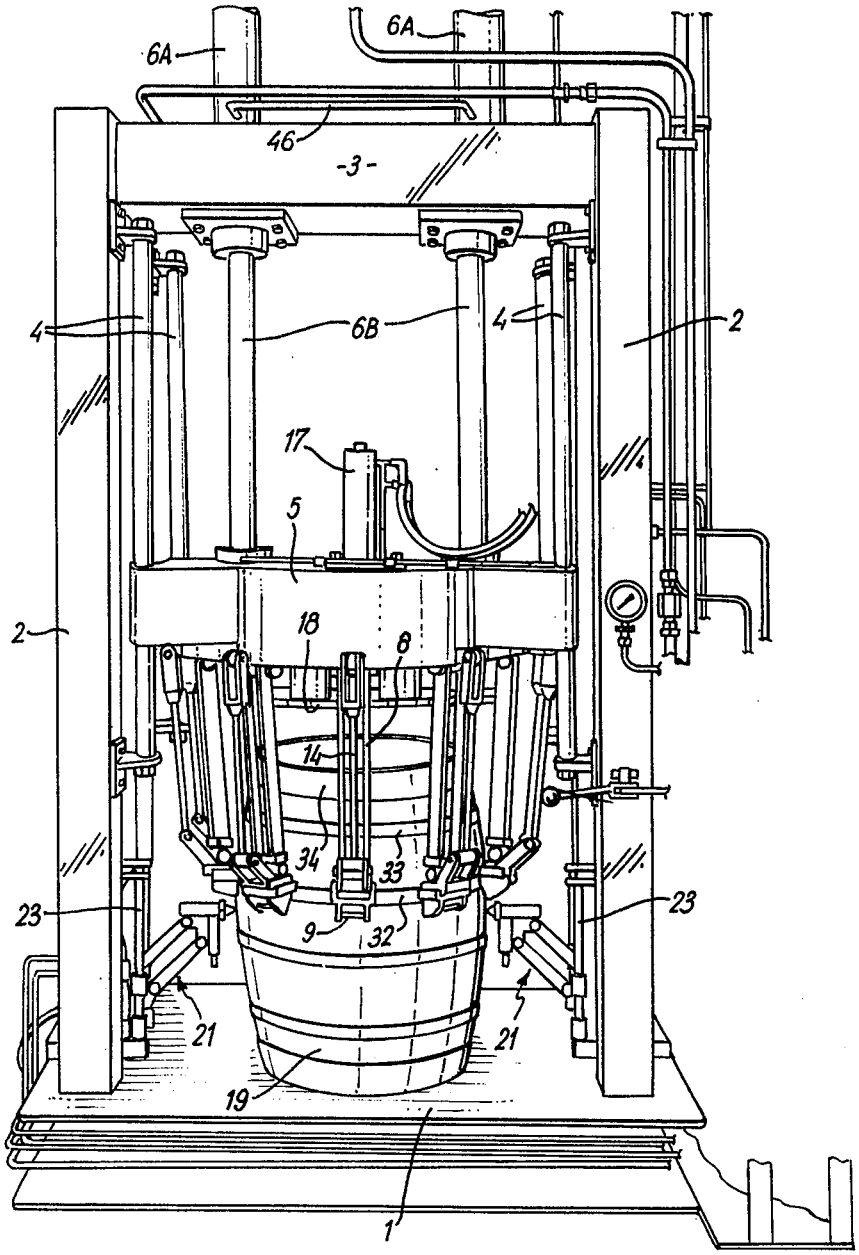
FIG. 2 is a view corresponding to FIG. 1 and showing the press head lowered and the push arms engaging a hoop on a barrel.
Figure 3:
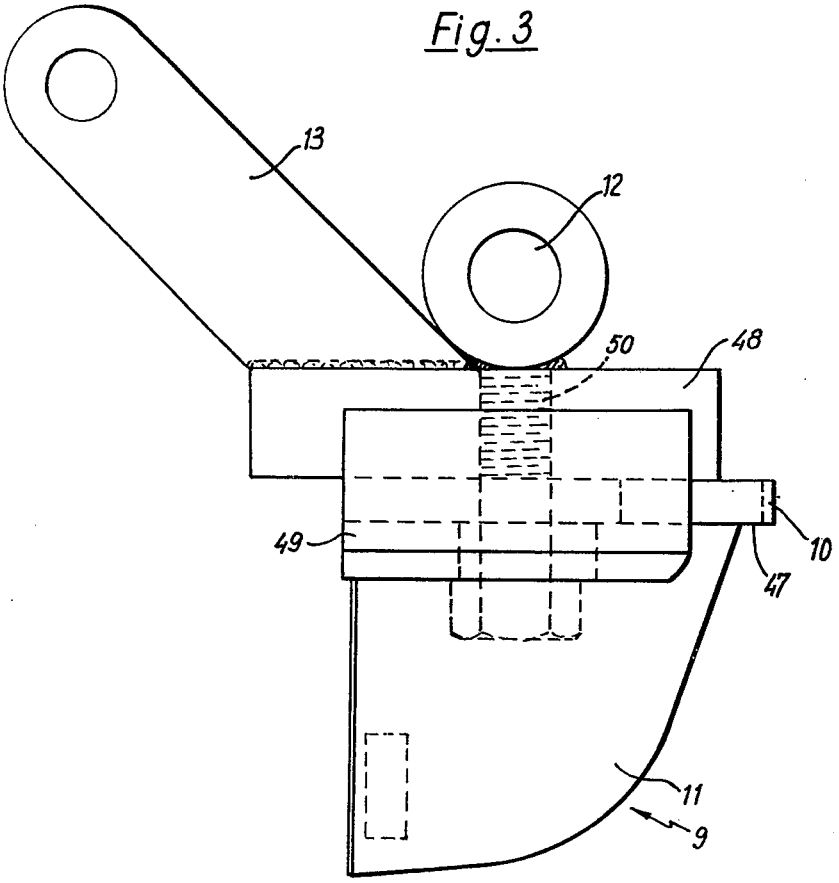
Figure 4:
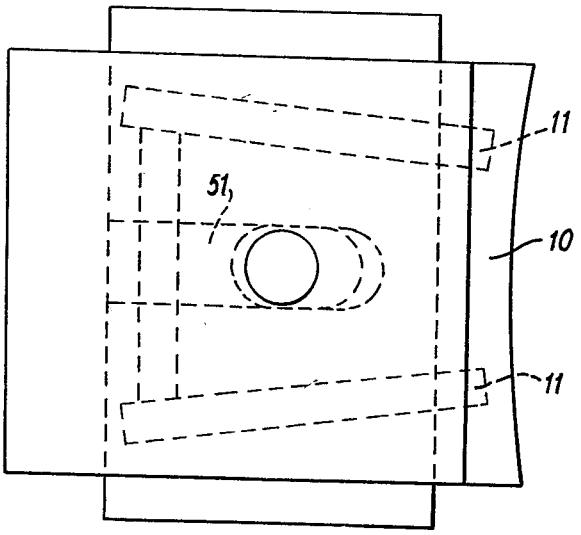
Figure 5:
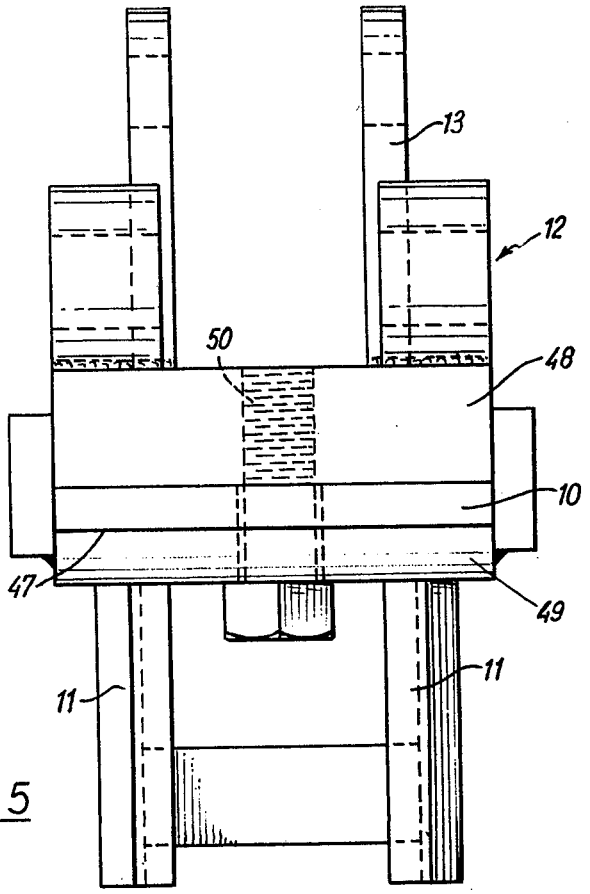
Figure 6:
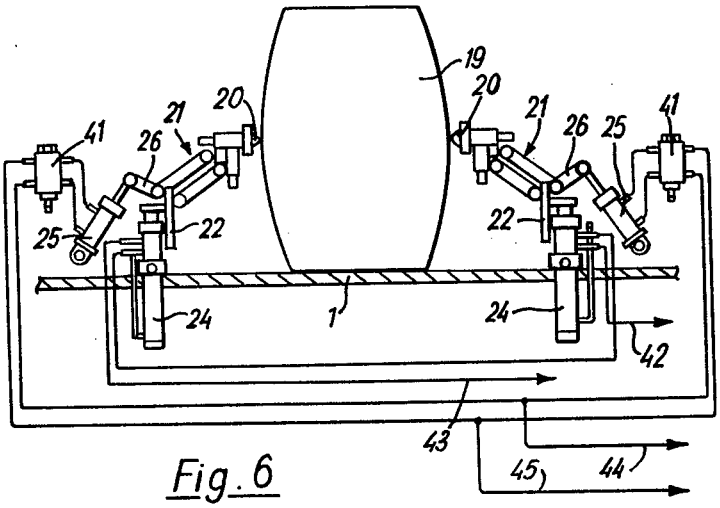

FIGS. 3, 4, and 5 are side, plan and front elevations respectively of a claw of the invention for use in the barrel hoop driver of FIGS. 1 and 2; and FIG. 6 is a fragmentary front elevation of the lifting means.

Referring to the drawings, a barrel hoop driver comprises a substantially rectangular base 1 mounted on a concrete foundation, not shown, and having a vertical square pillar at each corner, the pillars 2 being interconnected at their upper ends by a platform 3 so as to form an upright frame. A vertical guide rod 4 is carried by each pillar, and a press head 5 is journalled at its corners on the guide rods 4 so as to be slidable vertically within said frame towards and away from the base 1.

A pair of double-acting hydraulic rams 6 are provided for moving the press head 3 and have their cylinders 6A mounted on the platform 3 of the frame and their piston rods 6B connected to the press head 5. To ensure smooth operation, the rams 6 are hard chrome plated on the piston rods and in the bores of the cylinders. Pressure equalizing pipes 46 interconnect the cylinders 6A between their upper and lower ends to provide damping as the piston rods 6B move to the upper and lower limits of their travel.

The rams 6 are provided with "Shamban" seals to prevent scoring of the piston rods 6B.

Hydraulic pressure to actuate the rams is provided by a hydraulic pump 7 powered by a 15 h.p. 440 volt totally enclosed electric motor.

Ten upstanding push arms 8 are pivotally connected at their upper ends at 8A to the press head 5 and are spaced around the circumference of a circle and each arm 8 is pivotally biased towards the centre of the circle by a spring so that the lower ends of the arms are urged inwards. Each arm 8 is provided at its lower end with a claw 9 as shown in detail in FIGS. 3, 4, and 5. Each claw 9 has a hardened steel blade 10 of arcuate configuration at its leading edge to conform to the general profile of a barrel hoop. The blade 10 presents a downwardly-facing flanged face 47 for engagement with an upper edge of a hoop. The blade 10 is held between a support block 48 and a clamp plate 49 by a bolt 50 passing through them. The blade 10 is slotted at 51 so as to be adjustable in the depth of the flanged face 47.

A pair of guide plates 11 extend below the blade 10 one at either end portion of the blade 10, the plates 11 converging towards the free edge of the blade 10 and having their leading edges tapering downwards away from the free edge of the blade. Adjustment of the blade 10 thus alters the extent of the blade 10 beyond the guide plates 11, and this distance can be set in accordance with the thickness of a hoop to be driven onto the barrel.

Each claw 9 is connected to its push arm 8 by a pivot 12 and has an outwardly directed lug 13 which is pivotally connected at its free end to the lower end of a rod 14 which extends substantially parallel to the arm 8 and at its upper end is screwed into one end of a fork 15 whose other end is connected by a clevis pin 16 to the press head 5. The attitude of the blade 10 and the guide plates 11 can thus be adjusted by removing the pin 16, rotating the fork 15, and re-attaching the fork by the pin 16. The position of the arms 8 is controlled by means including a hydraulic ram 17 mounted on the press head 5 and having its piston rod connected to effect pivotal movement of the arms 8 towards and away from the centre of the circle formed by the arms, i.e. towards and away from the vertical axis of the hoop driver. A circular plate 18 is mounted on the press head 5 below the latter, the purpose of the plate 18 appearing hereinafter.

Means best shown in FIG. 6 for lifting and enabling inversion of a barrel 19 is provided on the frame and comprises a pair of pivot-clamp centres 20, diametrically opposed with respect to the barrel 19, and each mounted on a parallelogram linkage 21 which is hydraulically actuable so as to clamp the barrel 19 between the centres 20, and, when the barrel 19 is thus clamped, to raise same so that the barrel 19 may be turned on the centres 20 to an inverted position and then be lowered on to the base 1. Each parallelogram linkage 21 is carried by a bracket 22 which is slidably mounted on vertical guide rods 23. Each bracket 22 can be raised or lowered on the guide rods 23 by a hydraulic ram 24 in order to vary the height of the centres 20, and each centre 20 can be moved into and out of engagement with the barrel 19 by a hydraulic ram 25 acting on a lever 26 secured to a link of the linkage 21.

All the hydraulic rams are operated by control valves located in a box 27 mounted at one side of the frame, and valve control levers 28, 29, 30, 31 are grouped so that they are accessible to both hands of the operator at the same time.

In use, a hoop 32, FIG. 2, for example, is placed on the barrel 20 sitting on the base 1 and the press head 5 is lowered by the rams 6, and the push arms 8 are adjusted by the ram 17 in accordance with the diameter of the barrel, so that the guide plates 11 of the claws 9 engage and run down the outer faces of the staves until the flanged faces 47 of the blades 10 engage the hoop 32. The press head 5 is then moved further downwards by the rams 6 until the hoop 32 is forced along the tapered portion of the barrel into the desired position. The intermediate hoop 33 is driven on in the same manner. The end hoop 34 can be applied by placing it on the barrel and pressing it into the desired position by means of the plate 18, but when the barrel is being prepared for a second or subsequent filling the hoop 34 can be forced further onto the barrel by the plates 10, thus making it unnecessary to apply a new end hoop. The barrel is then lifted on the centres 20 and is inverted and the operation repeated.

The load applied hydraulically to the hoops may vary between about 5 and 30 tons.

It is to be understood that, as in a known manual process, a truss hoop is applied to the barrel staves prior to the application of the above-mentioned hoops.

In FIG. 1, 35 is a prefill tank, 36 is a prefill valve, 37 is a set-pin on top of the valve 36, 38 is a pressure gauge, 39 is an oil filter and 40 is an oil stop valve. The hydraulic circuit, which need not be described in detail, also includes a number of flow regulators and safety valves.

The barrel hoop driver above described, can be used very effectively with barrels of from 40 gallon to 120 gallon capacity, with barrels of from 32" to 52" in height and with end hoops of from 21" diameter to 34" diameter; and a barrel can be handled and the process completed on an average of less than one minute per barrel.

I claim:

1. A barrel hoop driver comprising a base, an upright frame mounted on said base, a press head slidably movable vertically towards and away from said base on guide rods carried by said frame, a plurality of push arms spaced around the circumference of a circle, and being pivotally mounted at one end on and movable with the press head, pivotally biased towards the centre of said circle, and adapted at their free ends drivingly to engage a hoop on a wooden barrel when the latter is supported on said base, and a pair of hydraulic rams for effecting movement of said press head and having their cylinders mounted on said frame and their pistons connected to said press head, wherein the free ends of the push arms each has a claw including a rigid driving member which presents a flanged face for engagement with a barrel hoop, and at least first and second separate mutually spaced apart guide members spaced inwardly from the edge of the flanged face by a distance about equal to the thickness of a barrel hoop and the mutual spacing of said first and second guide members being in a direction along the flanged face of the driving member, said first and second guide members having faces for guiding contact with a peripheral surface of said barrel, said faces being inclined to contact said peripheral surface substantially tangentially thereto, and the thickness and mutual spacing of the guide members being effective to substantially prevent accumulation of wood shavings on the driving member, the driving member being pivotally connected to its push arm.

2. A barrel hoop driver according to claim 1, wherein the guide members are in the form of plates extending towards and terminating short of the extreme edge of the flanged face.

3. A barrel hoop driver according to claim 2, wherein the leading edge of each plate is inclined away from extreme edge of the flanged face.

4. A barrel hoop driver according to claim 1, wherein the guide members are located one at each end portion of the flanged face.

5. A barrel hoop driver according to claim 1, wherein a lug is provided for connection to a rod on a machine for adjusting the attitude of the claw in use relative to a push arm to which it is connected.

* * * * *